US006013976A

United States Patent [19]

Gorski et al.

[11] Patent Number: 6,013,976

[45] Date of Patent: Jan. 11, 2000

[54] IN-LINE SB ELECTRON GUN WITH LARGE AND DEEP MAIN LENS APERTURES

[75] Inventors: Richard M. Gorski, Arlington Heights; Kenneth A. Guzowski, Hoffman Estates; Safir Mohammed, Elk Grove Village; Chester L. Zdanowski, Westmont; Edward J. Stosur, Westchester, all of Ill.

[73] Assignee: Zenith Electronics Corporation, Glenview, Ill.

[21] Appl. No.: 08/903,365

[22] Filed: Jul. 30, 1997

[51] Int. Cl.[7] ..... H01J 29/50

[52] U.S. Cl. ..... 313/412; 313/414; 313/441; 313/428

[58] Field of Search ..... 313/412, 409, 313/414, 428, 413, 441, 446, 447, 448, 449; 315/368.11, 368.15, 368.16, 382

[56] References Cited

U.S. PATENT DOCUMENTS

| | | | |
|---|---|---|---|
| 5,300,854 | 4/1994 | Kweon | 313/414 |
| 5,483,128 | 1/1996 | Chen | 313/414 |
| 5,488,265 | 1/1996 | Chen | 313/414 |

*Primary Examiner*—Nimeshkumar D. Patel
*Assistant Examiner*—Joseph Williams

[57] ABSTRACT

An in-line electron gun includes a main lens having G3 and G4 three aperture electrodes and corresponding chain link (extended aperture) electrodes. The outer apertures in each of the G3 and G4 electrodes are barrel shaped and the middle aperture is elliptical. This construction maximizes the aperture area. The spacings between the G3 and G4 electrodes and their corresponding chain link electrodes are maximized within the existing size constraints of the gun. The combined effect weakens the electric field of the main lens which reduces spherical aberration.

9 Claims, 2 Drawing Sheets

IN-LINE SB ELECTRON GUN WITH LARGE AND DEEP MAIN LENS APERTURES

BACKGROUND OF THE INVENTION AND PRIOR ART

This invention relates generally to in-line electron guns for use in three beam cathode ray tubes and especially to a novel in-line electron gun of the SB (symmetrical outer beam) type that has a main lens that is configured to reduce spherical aberration.

In-line electron guns for cathode ray tubes are well known in the art. U.S. Pat. No. 5,170,101, assigned to Zenith Electronics Corporation, describes an in-line SB type electron gun for use in a high resolution tri-beam color cathode ray tube that has a self convergent yoke, as do most modern color cathode ray tubes. As is well known, such yokes undesirably introduce beam shape distortions which may be compensated by various electron lens configurations, one such being a dynamic lens, often referred to as a Dynamic Quadropole. Other types of distortion are also introduced to the electron beams by the electron lenses of the gun.

A major problem is spherical aberration that results when all portions of the electron beam do not focus at the same point because of the inherent increase in focussing power with radial distance from the optical center of the lens. The effect is that of halo about the electron spot, which detracts from resolution. This type of distortion may be compensated by making the lens appear large in comparison with the size of the electron beam.

The present invention reduces spherical aberration in the electron gun by enlarging and weakening the apparent aperture of the main lens. This is accomplished by enlarging the apertures in the G3 and G4 electrodes and by separating them by a greater than normal amount.

OBJECTS OF THE INVENTION

A principal object of the invention is to provide a novel in-line electron gun.

Another object of the invention is to provide an in-line electron gun that compensates for spherical aberration.

A further object of the invention is to provide a low cost, in-line electron gun.

BRIEF DESCRIPTION OF THE DRAWINGS

These and other objects and advantages of the invention will be apparent upon reading the following description thereof in conjunction with the drawings, in which.

DESCRIPTION OF THE PREFERRED EMBODIMENT

Figure 1:
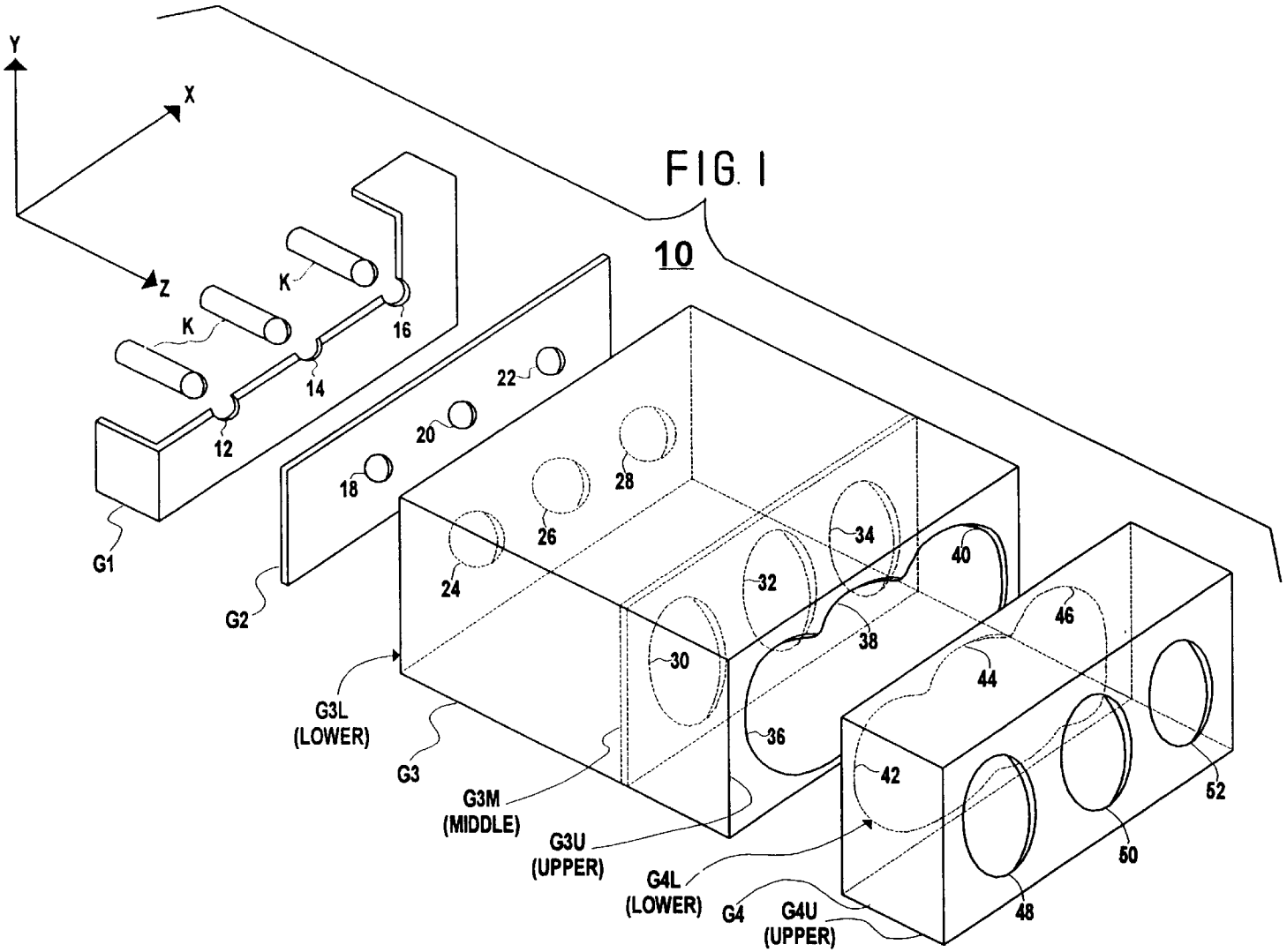
FIG. 1 is a simplified exploded view of an in-line SB type electron gun constructed in accordance with the invention.

Referring to FIG. 1, an axes reference that identifies the X, Y and Z axes of the in-line electron gun of the invention is illustrated in the upper left hand corner of the drawing. It should be noted that the electrode representations are for illustrative and descriptive purposes only and should not be considered as depicting the actual construction of the electron gun nor of the precise location of its various components. Three cathodes (K) are positioned along the X axis and generate clouds of electrons in a well known manner. A G1 control electrode (shown in cut-away), having three apertures 12, 14 and 16 in respective alignment with the three cathodes K, is positioned in the X-Y plane adjacent to and in Z axis alignment with the cathodes. Positioned closely adjacent thereto in the X-Y plane and along the Z axis, is a G2 accelerating electrode that includes three apertures 18, 20 and 22 in alignment with the corresponding apertures in control grid G1. An elongated substantialy tubular G3 electrode is spaced along the Z axis from G2 and consists of: a G3L (lower) plate with apertures 24, 26 and 28 therein that are larger than the G2 apertures; a G3M (middle) insert electrode with apertures 30, 32 and 34, shaped in accordance with the invention, as will be seen; and a G3U (upper) electrode with open, chain link-shaped, apertures 36, 38 and 40 therein. An elongated, tubular G4 electrode (shorter than the G3 electrode) consists of a G4L (lower) plate with chain link-shaped apertures 42, 44 and 46 and a G4U (upper) plate with apertures 48, 50 and 52 shaped according to the invention, and is spaced from electrode G3 along the Z axis. The chain link or extended apertures derive their name from the fact that they resemble chain links when the connection portions between the apertures are removed.

Figure 2:
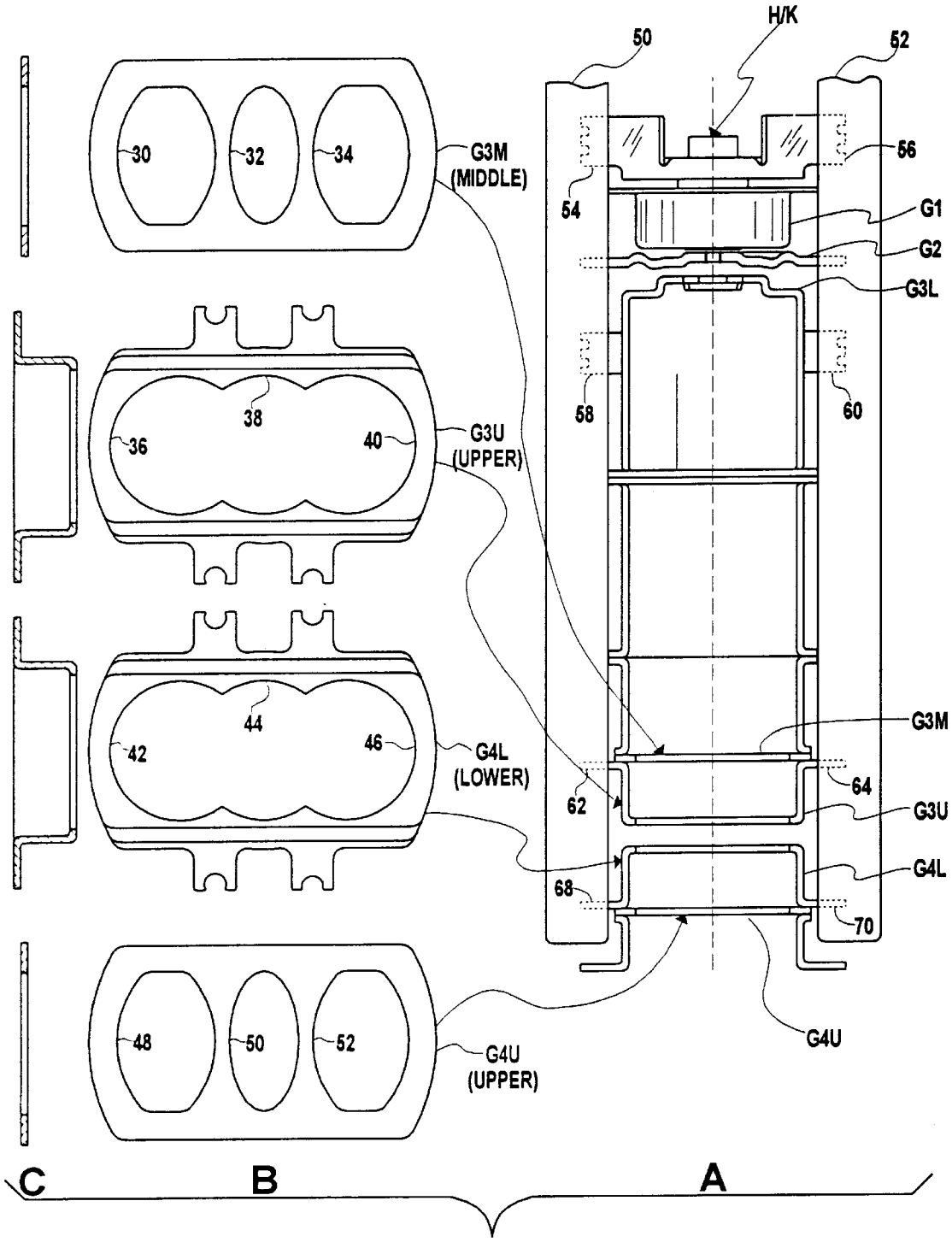
FIG. 2 depicts the various electrodes and apertures of the main lens in accordance with the present invention.

In FIG. 2, diagram A represents a side view (in the Y-Z plane) of a portion of an actual in-line SB electron gun constructed in accordance with the invention. Diagram B represents (90 degrees rotated) frontal views (along the Z axis) of the G3M and G3U and the G4L and G4U electrodes of the gun of diagram A, which comprises the main lens of the gun. Diagram C represents respective end views of these electrodes. It should be noted that the outer apertures 30,34 and 48,52 of the G3M and G4U electrodes, respectively, are large and barrel-shaped and the center apertures 32 and 50, respectively are large, but elliptically shaped. The apertures are shaped to utilize as much of the area of the respective G3M and G4U electrodes as possible while still forming a proper electron optical lens. These large shaped apertures, in conjunction with the abnormally large distances between the G3M and the G3U electrodes (and the distances between G3M and—G3U and G4L and G4U), respectively, significantly enlarge and weaken the main lens apparent aperture size, thereby minimizing spherical aberration. The large chain link apertures of G3U and G4L introduce a minimal amount of comatic aberration because of the non symmetrical configurations of the electron lenses. Some of the electrodes and electrode structures, such as the heater/cathode structure, the G1 electrode (not shown in detail in FIG. 2, the G2 electrode and the G3U and G4L electrodes, include mounting tabs, 54,56, 55,57, 58,60, 62,64 and 68,70 that are imbedded in the glass pillars or multiforms 50 and 52 that secure the elements of the electron gun in position, in a manner well known in the art.

In a prior art SB type in-line electron gun, the spacings between G3M and G3U and between G4L and G4U are about 0.10", whereas in the invention, these spacings are substantially increased to about 0.15". Also, as mentioned, the G3M and G4U apertures are made very large, (as large as possible considering the areas of the inserts, the need for structural integrity and maintaining a proper electron lens), which together with the increased G3M–G3U and G4L–G4U spacings, enlarge and weaken the apparent aperture and significantly reduces the spherical aberration imparted thereby to the electron beams.

It should also be noted that the G3M and G4U aperture plate inserts are flat (FIG. 2, diagram C). In the prior art these inserts had a configuration that was created by extrusion of the insert. The extruded construction did not facilitate precision assembly of the electron gun. The flat G3M and G4U electrodes enable positioning tolerances (along the Z axis) to be tightly controlled in an inexpensive manner.

It is recognized that modifications and changes to the described embodiment of the invention will occur to those skilled in the art without departing from its true spirit and scope. The invention is to be limited only as defined in the claims.

What is claimed is:

1. In an in-line three beam electron gun of the type including a main lens comprising first and second electrodes having apertures, first and second chain link electrodes positioned adjacent to the first electrode and the second electrode, respectively, along the Z-axis of the electron gun, and forming an electric lens field that undesirably introduces spherical aberration to the electron beams, the improvement comprising:

means for weakening said electric lens field formed by said first and second electrodes and for increasing the size of said apertures, along the Y axis of said electron gun, for reducing said spherical aberration, said weakening means also including means establishing a relatively large spacing between said first and second chain link electrodes and said first and second electrodes, respectively.

2. The electron gun of claim 1, wherein the outer ones of said apertures in each of said first and second electrodes are generally barrel shaped and the middle aperture is elliptical shaped to maximize the apparent size of the lens formed by said first and second electrodes, the long dimensions of said barrel shaped apertures and said elliptical shaped aperture extending along said Y axis of said electron gun.

3. The electron gun of claim 2 wherein said first and second electrodes comprise flat inserts.

4. A three beam in-line electron gun, having X, Y and Z axes, comprising:

means for generating electron beams;

main lens means including a first electrode and a second electrode in axial alignment along said Z axis for controlling electron beams from said generating means;

aperture means in each of said first electrode and said second electrode, said aperture means comprising large substantially barrel shaped outer apertures and an elliptically shaped middle aperture, said outer and middle apertures having their long dimensions extending along said Y axis; and the spacing between said first electrode and said second electrode being such that the electric lens field formed therebetween is weakened and, in conjunction with said large apertures, minimizes the introduction of spherical aberration to said electron beams.

5. The electron gun of claim 4, further including:

first and second chain link electrodes positioned adjacent to each other and to said first and second electrodes, in said main lens.

6. The electron gun of claim 5, wherein said apertures in said first electrode and said second electrode are maximized in area while still maintaining a proper electron lens field.

7. The electron gun of claim 6, wherein said first electrode and said second electrode comprise flat inserts.

8. An in-line electron gun having an X axis, a Y axis and a Z axis comprising:

a main lens including a first apertured electrode, a second apertured electrode, and first and second chain link electrodes;

means securing said first apertured electrode to said first chain link electrode and said second apertured electrode to said second chain link electrode;

means positioning said chain link electrodes along said Z axis and in alignment with each other, the spacing between said first apertured electrode and said second apertured electrode being selected to diminish the strength of the electric lens field of said main lens; and aperture means comprising large barrel shaped outer apertures and an elliptically shaped middle aperture in each of said first apertured electrode and said second apertured electrode, the long dimensions of said barrel shaped outer apertures and said elliptically shaped inner electrode extending along said Y axis, and the areas of said apertures being maximized in said electrodes, and both the shape and the spacing of said apertures cooperating for minimizing the introduction of spherical aberration to said electron beams.

9. The electron gun of claim 8, wherein said first apertured electrode and said second apertured electrode comprise flat inserts.

* * * * *